United States Patent [19]

Radlik

[11] Patent Number: 5,073,082

[45] Date of Patent: Dec. 17, 1991

[54] HYDRAULIC SCREW PUMP

[76] Inventor: Karl-August Radlik, Dahlienweg 4, 7070 Schwabisch Gmund, Fed. Rep. of Germany

[21] Appl. No.: 509,297

[22] Filed: Apr. 16, 1990

[30] Foreign Application Priority Data

Apr. 21, 1989 [DE] Fed. Rep. of Germany ..... 3913148

[51] Int. Cl.[5] ..... F01D 5/00

[52] U.S. Cl. ..... 415/72; 415/6; 416/224; 198/673; 198/676; 366/81; 366/319; 366/320

[58] Field of Search ..... 415/71, 72, 73, 74, 415/75, 6, 88; 366/318, 319, 320, 321, 81; 92/162 R; 416/224; 198/673, 676

[56] References Cited

U.S. PATENT DOCUMENTS

| | | | |
|---|---|---|---|
| 2,397,305 | 3/1946 | Wheat . | |
| 3,396,976 | 8/1968 | Reinhoudt et al. | 92/162 |
| 3,653,303 | 4/1972 | Zurcher | 92/162 |
| 4,274,751 | 6/1981 | Rector et al. | 366/319 |
| 4,772,177 | 9/1988 | Hayashi | 415/74 |

FOREIGN PATENT DOCUMENTS

| | | | |
|---|---|---|---|
| 2821142 | 11/1979 | Fed. Rep. of Germany | 416/224 |
| 3444440 | 8/1987 | Fed. Rep. of Germany . | |
| 0034499 | 2/1984 | Japan | 416/224 |
| 1277693 | 6/1972 | United Kingdom . | |
| 1330775 | 9/1973 | United Kingdom | 415/72 |

OTHER PUBLICATIONS

K. Radlik, Abwassertechnik, 1987, No. 2, pp. 52-53.

*Primary Examiner*—Edward K. Look
*Assistant Examiner*—Christopher M. Verdier
*Attorney, Agent, or Firm*—Foley & Lardner

[57] ABSTRACT

In a hydraulic screw pump, a sealing element for the peripheral edge of the rotary screw. The sealing element is formed with a channel along its length to fit over this edge of the rotary screw. The channel may be varied in depth to adjust the gap between the rotary screw and a water-carrying trough for the pump. The width of the channel may also be adjusted to accommodate rotary screws of varying thicknesses. The sealing element, thus, retains the desired width of the gap even though the edges of the rotary screw are chipped or worn away.

9 Claims, 2 Drawing Sheets

HYDRAULIC SCREW PUMP

BACKGROUND OF THE INVENTION

The invention relates to a hydraulic screw pump and more particularly to a hydraulic screw pump capable of feeding waste water.

German Patent 34 44 440 discloses a hydraulic screw pump for feeding waste water. The screw is installed within a trough, with a gap provided between the water-carrying trough and the screw. The gap is very small and, to act as a seal, must be equal or even in all places along the length of the pump. The functioning of the screw depends to a great extent on meeting this condition. The width of the gap is the difference between the outside diameter of the screw and the inside diameter of the trough, on the condition that the axes of the screw and trough are aligned. Methods for manufacturing wear-resistant troughs with small tolerances in their diameters are disclosed in said German patent 34 44 440 and also in Abwassertechnik, 1987, Nr. 2, p. 52–53.

Such narrow tolerances for the outside diameter of a screw were not possible before, because these cylinders and screws are made from metal plate, and are welded joint products. Furthermore, over time, improper and unwanted extensions of the gap result from wear of the screw and the trough. The sealing or a packing material provided on the outer circumference of the screw, as disclosed in the prior art, such as U.S. Pat. No. 4,772,177, is not applicable. A gap is needed between trough and screw, the gap serving to avoid wear and friction.

SUMMARY OF THE INVENTION

It is an object of the present invention to provide a hydraulic screw pump of a true-sized outer diameter.

Another object is to restore the correct diameter of screw, when the outer diameter of which has become insufficient because of wear.

These and other objects of the invention are obtained according to the present invention by a hydraulic screw pump for feeding waste water. The hydraulic pump comprises a screw body installed within a trough, a gap between the trough and the screw body, the gap being provided as a sealing means, and a separate gap sealing element adapted to the outside diameter of said screw and to the inside diameter of said trough, this separate gap sealing means being arranged only after the installation of said screw body.

An essential advantage of the present invention is to achieve a larger feeding capacity, the dimensions of the screw remaining the same. The power consumption is not increased because the smaller leakage improves the output. A further advantage is protection of the screw against wear and corrosion by means of the gap sealing element, resulting in its increased life. Due to the use of suitable materials, the gap sealing element itself has an increased life, but when worn out can be renewed without unmounting the screw or taking apart the pump.

Because of the different sizes of screws used with pumps and the necessary adaption to their diameters, the gap sealing element is manufactured by the treatment of semifinished material. Profile bars obtained in this way are adapted to the screw in sections by plastic deformation, locked, e.g., by clamps, and cooled down.

Other assembly means for these sealing elements are, of course, possible.

Cavities in the sealing element resulting from variations in the diameter of the screw on which the element is fitted, when the sealing element is shaped according to the circular shape of the trough and the periphery of the screw is eroded irregularly by wear, are filled up, e.g. by pouring a casting resin into the cavity.

According to another advantageous object of the invention, the gap sealing element consists of a material capable of being cast and which is self-adhering. The material is poured on the spirals of the screw by means of a moving mold.

DETAILED DESCRIPTION OF THE PREFERRED EMBODIMENTS

Figure 1:
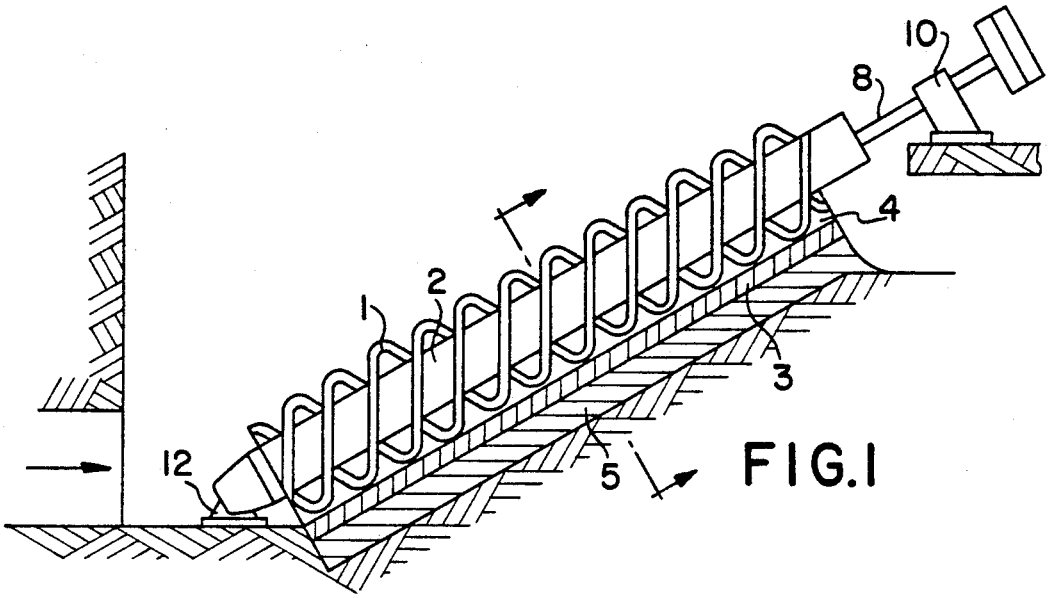
FIG. 1 is a simplified longitudinal cross-sectional view of a hydraulic screw pump according to the present invention.

Referring first to FIG. 1, an Archimedes screw arrangement for lifting waste water is illustrated. The screw includes a screw body 2, rotatably driven by a motor. A shaft 8 extending through a bearing in post 10 supports the upper end of the screw body. The other (lower) end of the screw body is supported by support 12. Waste water delivered to the lower end of the screw body is transported to the upper end of the body by the rotation of the screw. The screw body 2 lies above a waste water carrying trough 3.

Figure 3:
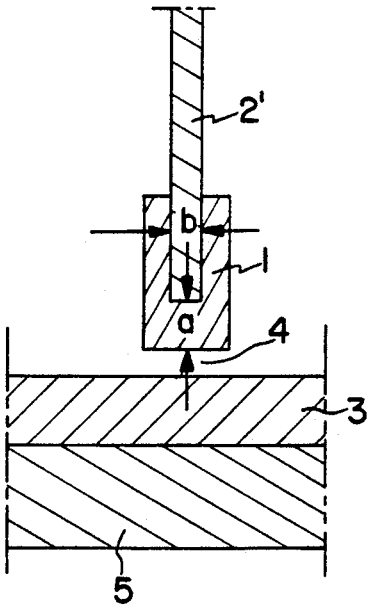
FIG. 3 is an enlarged view of a detail according to FIG. 2.

To achieve this upward fluid transport, the screw body carries a helically configured rotary or spiral screw element 2' (FIG. 3). The trough 3 lines a concrete semi-circular conduit 5, although other support structures for the trough could be used.

Figure 2:
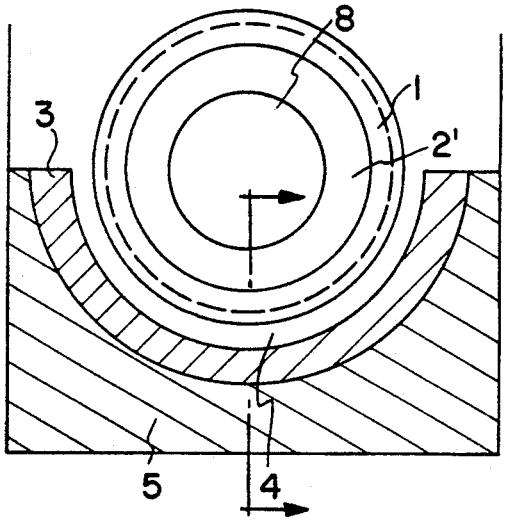
FIG. 2 is a transverse cross-sectional view of FIG. 1.

FIG. 2 illustrates the spacing of gap 4 between the screw body 2 (including the rotary screw element 2') and the trough 3. A gap sealing element 1 of channel-like cross-section (see FIG. 3) is provided along the peripheral edge of the rotary screw portion 2' of the screw body 2. The screw body 2 is positioned so that the rotary screw surrounding it lies a predetermined distance from the inside, concave surface of the trough 3. A gap between the outer edge or periphery of the rotary screw 2' and the trough 3 is needed to preclude power losses caused by friction between trough 3 and outer edge of the rotary screw 2'. The size of the gap depends on the deflection of the screw body 2.

FIG. 3 provides an enlarged cross-sectional view of the sealing element 1 affixed to the outer periphery of the rotary screw 2'. The sealing element 1 is generally channel-shaped, the peripheral edge of the rotary screw element 2' being inserted into its channel.

As further seen in FIG. 3, the sealing element 1 is adjustable in two dimensions. Adjustment of the "a" dimension determines the width of the gap 4, i.e., this dimension adapts the gap sealing element 1 to the outside diameter of the rotary screw and the inside diameter of the trough 3. The "b" dimension allows the sealing element 1 to be adapted to the thickness of the rotary screw 2'. The "b" dimension must be chosen to assure the firm setting of the sealing element 1 along the entire length of the rotary screw's periphery, even though the screw may have varying thicknesses at different points along its length.

The gap sealing element 1 may be made of thermoplastic material, and (depending on the material) adhered to the outer periphery of the rotary screw by plastic deformation or other known techniques. By varying the depth and width of the channel in the sealing element 1, the dimensions "a" and "b" may be varied to maintain the width of gap 4 constant and to accommodate rotary screws of varying widths. By doing so, any peripheral edge wearing of the rotary screw 2' can be compensated for and leakage down the trough minimized. The sealing element 1 can be placed on the rotary screw while the screw body is in place in the waste water transport system. Complete disassembly for access to the rotary screw is not necessary for installation or replacement of the sealing element.

Figure 4:
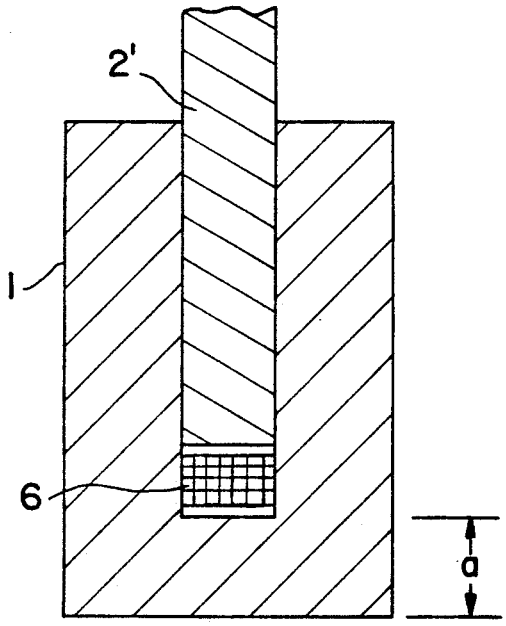
FIG. 4 is an enlarged view of a detail also according to FIG. 2, illustrating the use of a plastic filler material in adapting the sealing element to accommodate the various thicknesses and lengths of the rotary screw.

FIG. 4 shows a further embodiment of the invention, in which any gaps or spaces between the rotary screw 2' and the sealing element 1 can be filled with a suitable pliable material, for example, a thermoplastic. Such a pliable material 6 is shown in the space within a sealing element not occupied by the end of the rotary screw 2'. Similarly, gaps along the length of rotary screw 2' within the sealing element can be filled with a suitable pliable material.

What is claimed is:

1. A hydraulic screw pump for feeding waste water comprising:

a screw body;

a rotary screw helically attached to the screw body;

a trough, the screw body being positioned in relation to the trough to form a gap of fixed width between an outer periphery of the rotary screw and the trough; and a sealing element attached to the outer periphery of the rotary screw along its entire length, the dimensions of the sealing element being such as to maintain the gap width constant.

2. The hydraulic screw pump of claim 1, wherein the sealing element includes a channel extending along the length of the sealing element, the depth of the channel being dimensioned to receive the outer periphery of the rotary screw and maintain the gap constant even where the diameter of the rotary screw varies.

3. The hydraulic screw pump of claim 1, in which the sealing element is adapted to accommodate any varying thicknesses of the rotary screw.

4. The hydraulic screw pump of claim 3, wherein the sealing element includes a channel extending along its length, the channel adapted to accommodate the greatest thickness of the rotary screw.

5. The hydraulic screw pump of claim 1, wherein the sealing element is placed on the outer periphery of the rotary screw after the screw body is ready made.

6. The hydraulic screw pump of claim 1, wherein the sealing element is formed of a thermoplastic, the sealing element placed on the rotary screw in an elastic condition, thereafter to be permanently affixed to the rotary screw through plastic deformation of the sealing element by means of heat and subsequent cooling.

7. The hydraulic screw pump of claim 6, wherein the sealing element is manufactured by the treatment of a semi-finished material.

8. The hydraulic screw pump of claim 6, wherein cavities in the sealing element resulting from variations in the diameter of the rotary screw are filled with plastic material to assure proper fit of the sealing element along the entire length of the rotary screw.

9. The hydraulic screw pump of claim 1, wherein the sealing element comprises a casting resin coated onto the peripheral edges of the rotary screw by use of a movable casting mold and adhering after setting of the resin.

* * * * *